US005565829A

United States Patent [19]

Loraas et al.

[11] Patent Number: 5,565,829

[45] Date of Patent: Oct. 15, 1996

[54] SIDE PIVOT SEAT

[75] Inventors: Orlan J. Loraas; Charles Deyo, both of Lisbon; James E. Asche, Milnor; Scott B. Jacobson, Kindred; Joseph R. Volk, Oakes, all of N. Dak.

[73] Assignee: Clark Equipment Company, Woodcliff Lake, N.J.

[21] Appl. No.: 418,103

[22] Filed: Apr. 6, 1995

[51] Int. Cl.[6] ..... H01H 9/00

[52] U.S. Cl. ..... 335/205; 200/85 A

[58] Field of Search ..... 335/206–7; 200/85 A

[56] References Cited

U.S. PATENT DOCUMENTS

| | | | |
|---|---|---|---|
| 3,321,663 | 5/1967 | Poznik . | |
| 3,838,748 | 10/1974 | Gray et al. . | |
| 4,057,213 | 11/1977 | Kokkila . | |
| 4,095,770 | 6/1978 | Long . | |
| 4,361,741 | 11/1982 | Leskoverc et al. . | |
| 4,389,154 | 6/1983 | Minor et al. . | |
| 4,509,614 | 4/1985 | Bando et al. . | |
| 4,782,938 | 11/1988 | Cooper et al. . | |
| 4,844,196 | 7/1989 | Clevenger, Jr. et al. . | |
| 4,856,612 | 8/1989 | Clevenger, Jr. et al. . | |
| 4,871,044 | 10/1989 | Strosser et al. . | |
| 4,969,533 | 11/1990 | Holm et al. . | |
| 5,044,472 | 9/1991 | Dammeyer et al. . | |
| 5,109,945 | 5/1992 | Koga . | |
| 5,120,980 | 6/1992 | Fontaine . | |
| 5,156,232 | 10/1992 | Muroya et al. . | |
| 5,159,305 | 10/1992 | Hutchinson | 335/207 |
| 5,162,626 | 11/1992 | Hutchison et al. . | |
| 5,203,440 | 4/1993 | Peterson, Jr. et al. . | |
| 5,232,243 | 8/1993 | Blackburn et al. . | |
| 5,358,305 | 10/1994 | Kaneko et al. . | |
| 5,373,125 | 12/1994 | Ford et al. | 335/205 |

*Primary Examiner*—Lincoln Donovan

*Attorney, Agent, or Firm*—Westman, Champlin & Kelly, P.A.

[57] ABSTRACT

A seat assembly and a power machine includes a seat having a front portion, a back portion, and first and second side portions. A base plate supports the seat, and a hinge is pivotably connected between the first side portion of the seat and the base plate. The second side portion of the seat is connected to the base plate to allow limited movement of the second side portion of the seat relative to the base plate. A spring is coupled to the seat and to the base plate and urges the second side portion of the seat away from the base plate. A Hall effect sensor housing supports a Hall effect sensor and is operably mounted to one of the base plate and the seat. A magnet is operably mounted to another the base plate and the seat and is positioned to cooperate with the Hall effect sensor so that the Hall effect sensor provides a sensor indicative of a position of the second side portion of the seat.

23 Claims, 3 Drawing Sheets

SIDE PIVOT SEAT

BACKGROUND OF THE INVENTION

The present invention relates to a seat assembly in a power machine. More particularly, the present invention relates to an operator presence sensing system sensing operator presence in a seat of a power machine.

Vehicle seat switches have been used in the past in order to determine the presence of an operator in a power machine. Such seat switches typically involve a spring, or some type of bias member which biases the seat of the power machine in an upward direction. A switch is generally located beneath the seat and is actuated when a load is applied to the seat, and deactuated when the load is removed from the seat. The switch is typically coupled to an electrical circuit which provides a signal indicative of whether the load is applied to the seat.

In addition, some conventional seat switch mechanisms are configured to operate with seats which pivot in a fore and aft direction, or seats which move in a substantially vertical direction under an operator load. Further, such seats are normally adjustable in the fore and aft (generally horizontal) direction to accommodate various operator sizes. Thus, in order to actuate the seat switch, the operator has been required to load the seat with a net weight sufficient to provide downward movement of a portion of the seat, about the fore and aft pivot, to actuate the seat.

When the machine is operated by an operator of small physical stature, that operator typically requires the seat to be adjusted forward. This moves the effective net weight of the operator forward relative to the pivot point of the seat. The combination of a lighter weight operator exerting a smaller load on the seat, and the seat being moved forward (for a front pivot seat) reduces the positive downward force bias on the seat that is necessary to keep the seat switch in operating position.

Further, it is common for the operator of such a machine to lean forward to line up and adjust elevation of a loader lift arm attachment mounting frame with the attachment frame of a tool, such as a bucket, which is to be used on the machine. As the operator leans forward, particularly the smaller or shorter operator, the seat switch can temporarily disengage certain operations of the vehicle. Thus, it is inconvenient for such operators, during mounting of an attachment, to concentrate on aligning the lift arm attachment mounting frame with the attachment frame on the tool, while also concentrating on keeping enough weight on the seat to keep the seat switch engaged.

SUMMARY OF THE INVENTION

A seat assembly on a power machine includes a seat having a front portion, a back portion, and first and second side portions. A base plate supports the seat, and a hinge is pivotably connected between the first side portion of the seat and the base plate. The second side portion of the seat is connected to the base plate to allow limited movement of the second side portion of the seat relative to the base plate. A spring is coupled to the seat and to the base plate and urges the second side portion of the seat away from the base plate. A Hall effect sensor housing supports a Hall effect sensor and is operably mounted to one of the base plate and the seat. A magnet is operably mounted to another of the base plate and the seat and is positioned to cooperate with the Hall effect sensor so that the Hall effect sensor provides a signal indicative of a position of the second side portion of the seat.

DETAILED DESCRIPTION OF THE PREFERRED EMBODIMENTS

Figure 1:
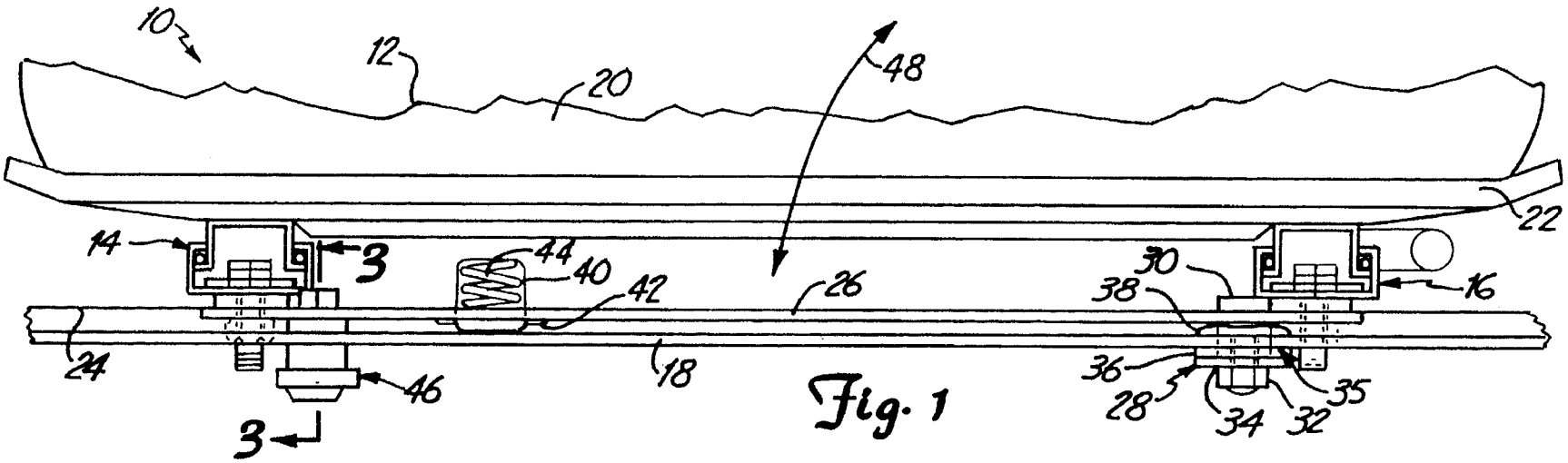
FIG. 1 is a front elevational view of an operator presence sensing system and seat assembly according to the present invention, in an occupied position.

FIG. 1 is a front elevational view of a seat assembly according to the present invention. Seat assembly 10 includes seat 12, support rail assemblies 14 and 16, apron 24, support plate 26, and seat pan 18. Seat pan 18 is typically mounted to the frame or other structural support portion of a power machine, such as a skid steer loader (not shown).

Seat 12 typically includes a seat cushion 20 which is mounted on a relatively rigid structural support member 22. The structural support member 22 is mounted, at its lower end, to support rail assemblies 14 and 16 which are, in turn, fixedly attached to apron 24 and support plate 26. Support rail assemblies 14 and 16 are commonly known rail assemblies which typically have an engagement lever (not shown) and allow seat 12 to be adjusted in a fore and aft direction (better shown in FIG. 2) to suit the particular size of an individual operator.

Support plate 26 is mounted to seat pan 18 by a pair of identical fore and aft grommet assemblies 28 (only one of which is shown in FIG. 1). In the preferred embodiment, grommet assemblies 28 include bolt 30, nut 32, washer 34 and rubber grommet 35. Grommet 35 extends through an aperture in seat pan 18 and has extending portions 36 and 38. Rubber grommet portion 36 is sandwiched between washer 34 and seat pan 18, and rubber grommet portion 38 is sandwiched between seat pan 18 and support plate 26. Thus, each grommet assembly 28 connects seat pan 18 to support plate 26 in a resilient and moveable fashion.

Support plate 26 also has a spring housing 40 connected thereto. Spring housing 40 is preferably a cylindrical housing which extends through an aperture in support plate 26 and has an annular flange 42 which can be fixedly connected to support plate 26 by any suitable means. Spring housing 40 holds compression spring 44 therein. In one preferred embodiment, the load of spring 44 holds housing 40 within the aperture in support plate 26. Compression spring 44 exerts a force on seat pan 18 and support plate 26, urging support plate 26 away from seat pan 18. When seat assembly 10 is in the position shown in FIG. 1, compression spring 44 is compressed between housing 40 and seat pan 18, almost completely within housing 40.

Seat pan 18 also has an operator presence sensor assembly 46 (sensor assembly 46) mounted thereon. Sensor assembly 46 is, in the preferred embodiment, a Hall effect sensor assembly which has a magnet operably coupled to support plate 26 and a Hall effect sensor operably coupled to seat pan 18.

In operation, an operator sitting on seat cushion 20 exerts a force in the downward direction, causing seat assembly 10 to be in an occupied position (as shown in FIG. 1), compressing spring 44 between seat pan 18 and housing 40. This causes Hall effect sensor assembly 46 to produce a signal indicative of seat 12 being in the occupied position. However, when an operator is not sitting on seat cushion 20, compression spring 44 causes support plate 26 (and seat 12) to pivot about grommet assembly 28 in a direction generally indicated by arrow 48 and to assume an unoccupied position. Essentially, compression spring 44 expands, lifting base plate 26 and seat 12 upwardly in an arc about grommet assembly 28, away from seat pan 18.

Figure 1A:
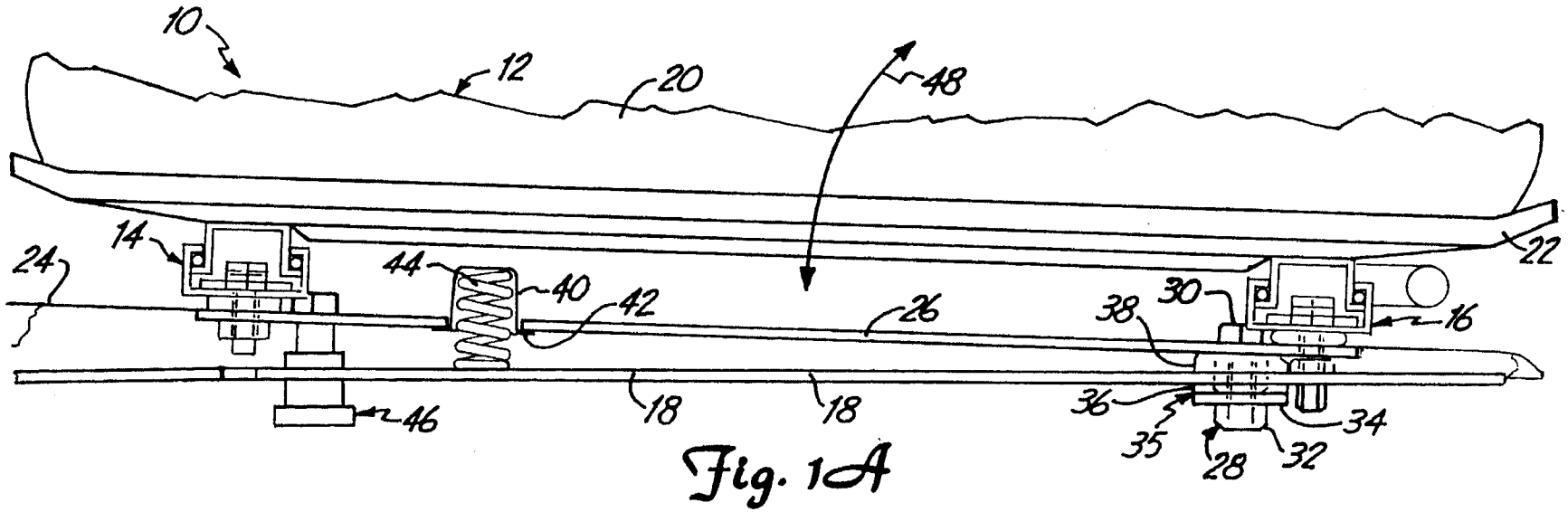
FIG. 1A is a front elevational view of an operator presence sensing system and seat assembly according to the present invention, in an unoccupied position.

FIG. 1A shows seat assembly 10 in the unoccupied position. FIG. 1A shows that support plate 26 pivots in the direction indicated by arrow 48 about grommet assembly 28. This pivoting motion is caused by compression spring 44 which decompresses to lift plate 26.

FIG. 1A also shows that when base plate 26 has pivoted to the position shown, an upper portion of Hall effect sensor assembly 46, which carries the magnets, is lifted within a lower portion of Hall effect sensor assembly 46. This causes Hall effect sensor assembly 46 to produce a second signal, indicating that seat 12 is in the unoccupied position. The configuration and operation of Hall effect sensor assembly 46 are described in greater detail with respect to FIGS. 3A and 3B.

Both FIGS. 1 and 1A show that apron 24 preferably extends outwardly over a perimeter of seat pan 18. Apron 24 is preferably formed of a flexible material. In a preferred embodiment, apron 24 extends outwardly in this fashion in all directions, and bends slightly downward over seat pan 18. This significantly reduces the possibility that any debris or foreign objects can enter beneath support plate 26. Preferably, apron 24 is formed of a material such as nylon or rubber which can easily withstand weather and temperature extremes to, for example, 40°–50° F. below zero.

Figure 2:
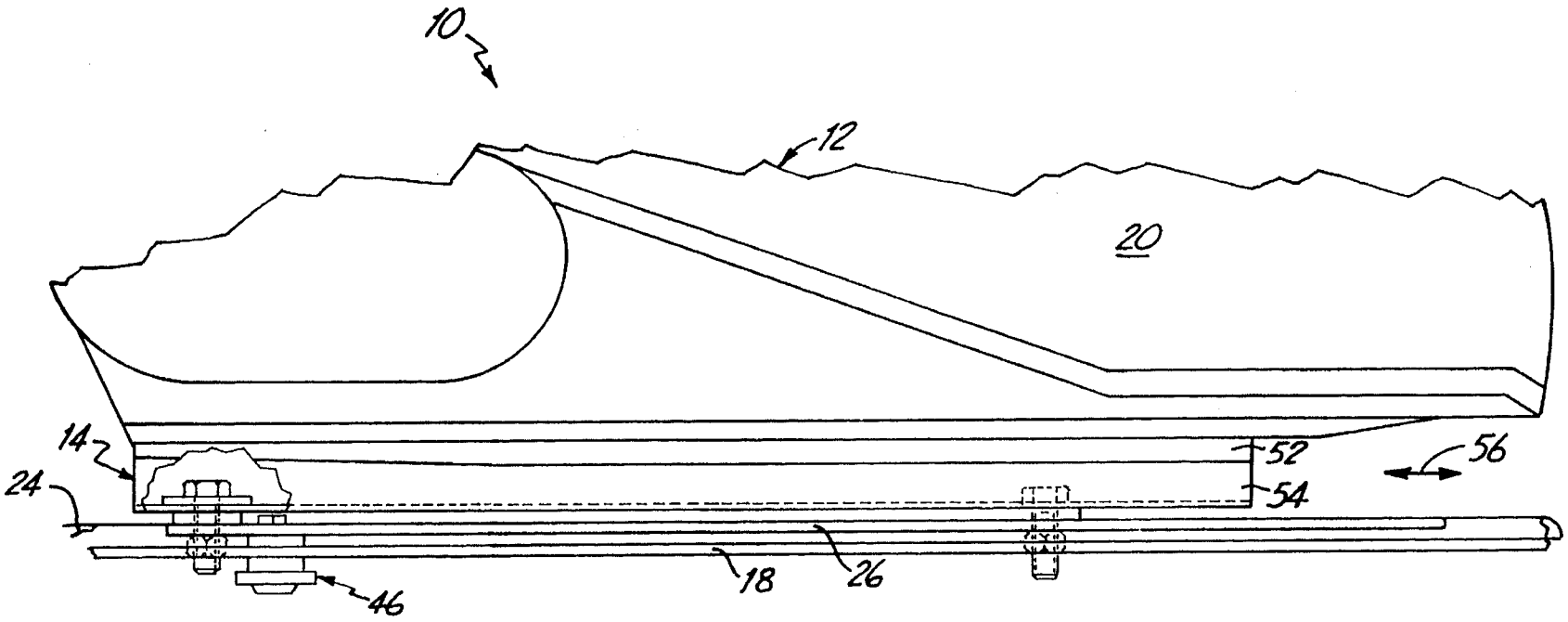
FIG. 2 is a side elevational view of the seat assembly shown in FIG. 1, with a portion cut away.

FIG. 2 is a side elevational view of seat assembly 10 shown in FIG. 1. FIG. 2 better illustrates that support rail assemblies 14 and 16 include a pair of generally opposing rails 52 and 54, which are slidable relative to one another. This allows seat cushion 20 to be moveable or adjustable in the fore and aft directions as indicated by arrow 56. For the sake of clarity, a portion of seat assembly 10 has been eliminated from FIG. 2.

Figure 3A:
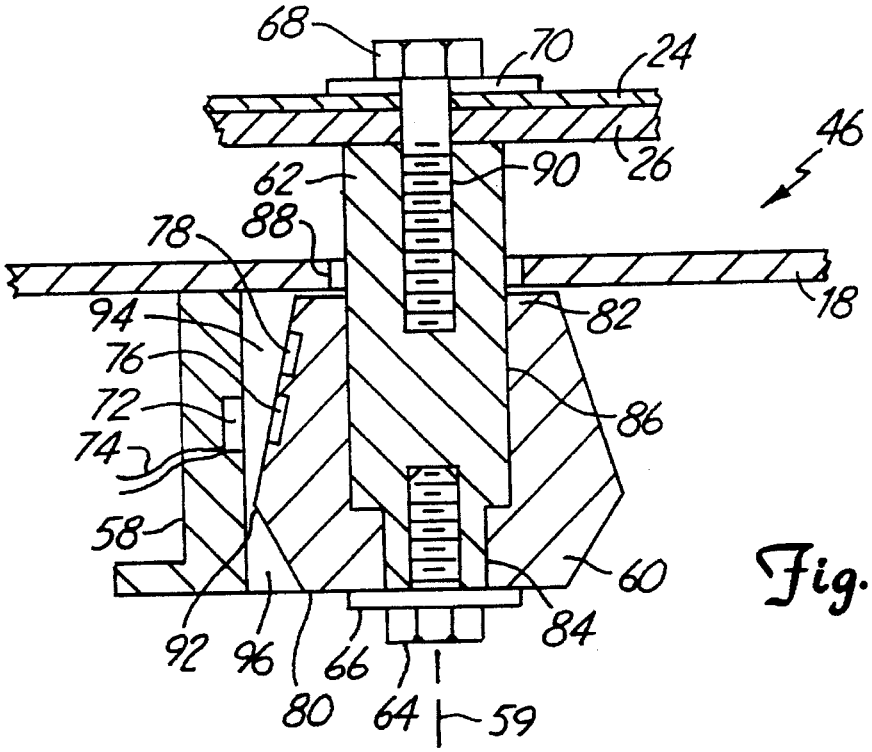
FIG. 3A is an enlarged sectional view of an operator presence sensor assembly according to the present invention in an unoccupied position rotated 90 degrees.

FIG. 3A is a side sectional view of Hall effect sensor assembly 46 taken along lines 3—3 in FIG. 1. Sensor assembly 46 includes sensor housing 58, magnet support member 60, shaft 62, cap screw 64, washer 66, bolt 68 and washer 70. Housing 58 is coupled to seat pan 18 by any suitable means, such as adhesive, welding, or with screws. In one preferred embodiment, housing 58 is formed in a half cylinder, or a crescent shape and generally defines an axis 59. Housing 58 supports Hall effect sensor 72 at an inner periphery of housing 58. Hall effect sensor 72 is coupled to a controller (not shown) or other electric circuit by conductors 74.

Magnet support member 60 supports a pair of oppositely polarized magnets 76 and 78 on an external periphery of magnet support member 60. Magnets 76 and 78 interact with Hall effect sensor 72 such that Hall effect sensor 72 provides a signal indicative of the position of seat 12. This will be described in greater detail later in the specification.

Magnet support member 60 has a first end 80 and a second end 82. A generally axial bore 84 extends through first end 80 to receive a portion of shaft 62. Cap screw 64 and washer 66 are provided to connect magnet support member 60 to shaft 62. Second end 82 of magnet support member 60 has a second, generally axial, bore 86 extending therein for receiving another portion of shaft 62. In the preferred embodiment, axial bore 86 has a dimension which closely approximates an external peripheral dimension of shaft 62 so that shaft 62 fits within bore 86.

Seat pan 18 has an aperture 88 formed therein. Aperture 88 has an internal dimension which is larger than the external dimension of shaft 62. Thus, shaft 62 can freely move within aperture 88. Shaft 62 also has a generally axial bore 90 for receiving bolt 68. Therefore, bolt 68 and washer 70 fixedly secure shaft 62 (and consequently magnet support member 60) to support plate 26 and apron 24

Second end 82 of magnet support member 60 has an outer dimension which is slightly larger than aperture 88. Therefore, as compression spring 44 urges support plate 26 away from seat pan 18, magnet support member 60 and shaft 62 move along with support plate 26 until the second end 82 of magnet support member 60 engages seat pan 18. Once in that position (the position shown in FIG. 3A), magnet support member 60 remains in that position under the force exerted by spring 44 until an operator sits on seat 12, or until another load is applied to seat 12. When in the position shown in FIG. 3A, magnet 76 interacts with Hall effect sensor 72 so that Hall effect sensor 72 provides a signal along conductor 74 indicative of the fact that seat 12 is in an unloaded or unoccupied position.

It is worth noting that magnet support member 60 has an exterior surface which is essentially a double taper between first end 80 and second 82. In other words, the outer surface of magnet support member 60 tapers outwardly, to a larger radial dimension, between first end 80 and an intermediate portion 92. The outer surface of magnet support member 60 then tapers inwardly to a smaller radial dimension from intermediate portion 92 to second end 82. At intermediate portion 92, magnet support member 60 preferably has an outer dimension which brings the outer surface of magnet support member 60 very close to the inner semi-cylindrical or crescent shaped surface of housing 58. This defines a sensor chamber or passageway 94 between housing 58 and magnet support member 60 when magnet support member 60 is the position shown in FIG. 3A. This substantially reduces the likelihood that debris will enter into housing 58. This also defines a lower chamber or passageway 96 between magnet support member 60 and the inner surface of housing 58. However, as will be described with reference to FIG. 3B, lower chamber 96 is cleared of debris every time an operator sits on seat 12.

Figure 3B:
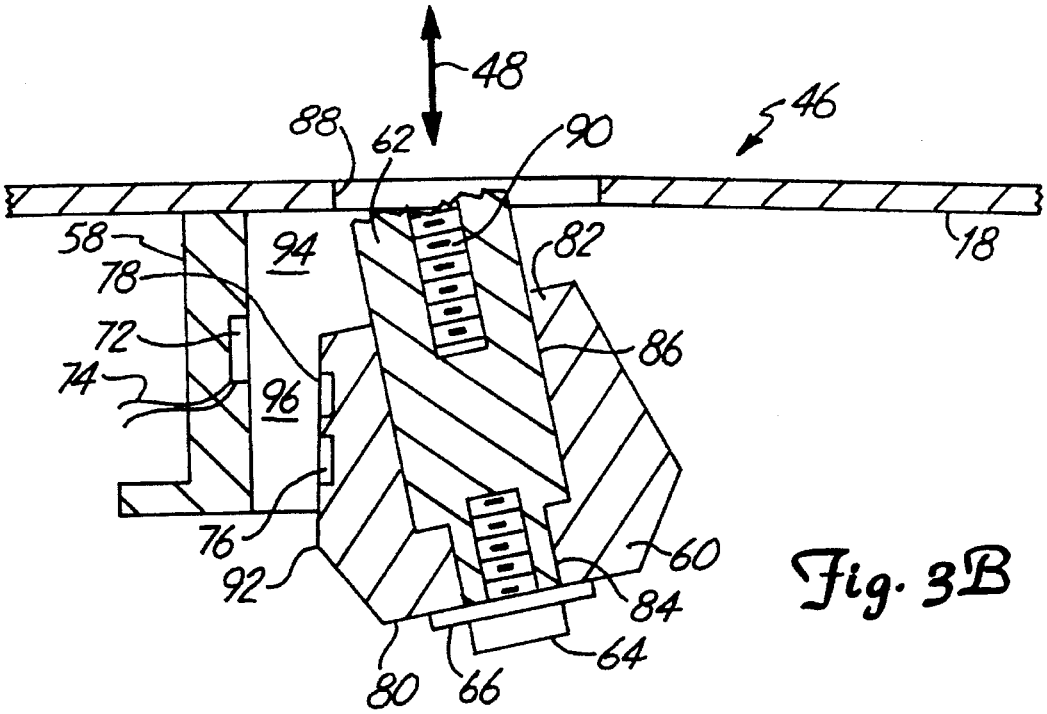
FIG. 3B is a side sectional view of the sensor assembly shown in FIG. 3A rotated 90 degrees, in an unoccupied position.

FIG. 3B shows a portion of sensor assembly 46 shown in the operator present or seat occupied position. This view is rotated 90 degrees from that shown in FIG. 3A. Seat 12 is in the same position as that illustrated in FIG. 1. When an operator sits on seat 12, support plate 26 (and hence shaft 62 and magnet support member 60) pivot about grommet assembly 28 (shown in FIG. 1) along an arc indicated by arrow 48. While, in the preferred embodiment, movement of support plate 26 is only approximately 3/10 of an inch between the occupied and unoccupied positions shown in FIGS. 1 and 1A, respectively, and thus while the pivoting along arc 48 is only very slight, it has been greatly exaggerated in FIG. 3B to more clearly illustrate operation of magnet assembly 46.

FIG. 3B shows that, when the seat is moved downward along arc 48, magnet 76 passes down below Hall effect sensor 72, and oppositely polarized magnet 78 passes down in front of Hall effect sensor 72. This causes Hall effect sensor 72 to provide a signal on conductors 74 indicating that the position of seat 12 has changed, and is now in the occupied position. Also, as magnet support member 60 moves downward along arc 48, the exterior surface of magnet support member 60 which supports magnets 76 and 78 becomes more parallel to the interior surface of housing 58 supporting Hall effect sensor 72. This essentially opens chamber 94 so that it communicates with chamber 96 and with the exterior of housing 58. Thus, any debris which has accumulated in chamber 94 exits through chamber 96 and out of housing 58. Further, intermediate portion 92, which closely follows the inner surface of housing 58, moves down and out through the lower opening in housing 58 when the seat is occupied. This essentially pushes any debris which has gathered in chamber 96 out of housing 58 so that it is no longer accumulated within housing 58.

It has been observed that operation of sensor assembly 46, using the presently disclosed configuration, essentially expels the debris from within housing 58 in a very efficient manner. Further, when this configuration is used with apron 24, there is a further reduction in the likelihood that any debris will collect near sensor assembly 46.

Further, the present seat assembly is a side-pivot assembly. This provides efficient actuation of sensor assembly 46 regardless of the fore and aft position of seat 12, and regardless of the physical stature of most operators.

It should also be noted that, in one preferred embodiment, a second bushing is also mounted to support plate 26 and seat pan 18. The second bushing is mounted near the front of seat assembly 10 and acts as another stop (along with sensor assembly 46) to limit movement of seat 12 along arc 48. Further, in another preferred embodiment, the grommet assemblies 28, the sensor assembly 46 and the second bushing are all mounted using the seat studs used in mounting support rail assemblies 14 and 16.

Although the present invention has been described with reference to preferred embodiments, workers skilled in the art will recognize that changes may be made in form and detail without departing frown the spirit and scope of the invention.

What is claimed is:

1. A seat assembly in a power machine, comprising:

a seat having a front portion, a back portion, a first side portion and a second side portion generally opposing the first side portion;

a seat pan supporting the seat;

a hinge pivotably connecting the first side portion of the seat to the seat pan;

a connection assembly connecting the second side portion of the seat to the seat pan to allow limited movement of the second side portion of the seat relative to the seat pan, between a first position when the second side portion of the seat is positioned a first distance from the seat pan and a second position when the second side portion of the seat is positioned a second distance from the seat pan;

a spring, coupled to the seat and the seat pan, urging the second side portion of the seat to pivot about the hinge and move away from the seat pan;

a Hall effect sensor housing supporting a Hall effect sensor and being operably mounted to one of the seat pan and the seat; and a first magnet operably mounted to another of the seat pan and the seat and positioned to cooperate with the Hall effect sensor so the Hall effect sensor provides a sensor signal indicative of the second side portion of the seat being in one of the first and second positions.

2. The seat assembly of claim 1 wherein the first magnet is supported by a magnet support member and wherein the magnet support member and the Hall effect sensor housing have generally opposing surfaces arranged such that a clearance between the opposing surfaces changes as the second side portion of the seat moves between the first and second positions.

3. The seat assembly of claim 1 and further comprising:

an apron coupled to the seat and extending generally about the seat pan.

4. The seat assembly of claim 3 and further comprising:

a support plate fixedly coupled to the seat and pivotably mounted to the seat pan by the hinge.

5. The seat assembly of claim 4 wherein the apron is fixedly connected to the support plate for movement with the support plate.

6. The seat assembly of claim 4 wherein the spring is operably mounted to one of the support plate and the seat pan and located to urge the support plate away from the seat pan.

7. The seat assembly of claim 4 wherein the hinge comprises:

a resilient, compressible member coupled to the seat pan and the support plate to provide a movable connection between the seat pan and the support plate.

8. The seat assembly of claim 7 wherein the resilient, compressible member comprises a rubber grommet.

9. The seat assembly of claim 1 wherein the Hall effect sensor housing has a peripheral surface and further comprising:

a magnet support member supporting the first magnet and having a peripheral surface; and wherein the peripheral surfaces of the magnet support member and the Hall effect sensor housing are contoured such that clearance between the peripheral surfaces varies.

10. The seat assembly of claim 9 wherein the magnet support member is mounted to the seat and is movable relative to the Hall effect sensor housing.

11. The seat assembly of claim 10 wherein the peripheral surface of the magnet support member tapers away from the peripheral surface of the Hall effect sensor housing.

12. The seat assembly of claim 11 wherein the Hall effect sensor housing is shaped to form an inner portion and wherein the magnet support member is movable within the inner portion of the Hall effect sensor housing.

13. The seat assembly of claim 12 wherein the peripheral surface of the Hall effect sensor housing is an inner peripheral surface generally defining an axis and wherein the peripheral surface of the magnet support member is an outer peripheral surface tapered such that clearance between the inner peripheral surface of the Hall effect sensor housing and the outer peripheral surface of the magnet support member is different when measured at a first point along the axis and at a second point along the axis.

14. The seat assembly of claim 13 wherein the outer peripheral surface of the magnet support member is formed as a conical taper.

15. The seat assembly of claim 13 wherein the outer peripheral surface of the magnet support member has a first conically tapered portion and a second conically tapered portion coupled to the first conically tapered portion at an intermediate portion, clearance between the intermediate portion and the inner peripheral surface of the Hall effect sensor housing being less than clearance between the inner peripheral surface of the Hall effect sensor housing and the first tapered portion and which is less than clearance between the inner peripheral surface of the Hall effect sensor housing and the second tapered portion.

16. The seat assembly of claim 15 and further comprising:

a second magnet supported by the magnet support member proximate the first magnet, the first magnet and the second magnet being oppositely polarized.

17. A Hall effect sensor assembly for sensing seat position of a movable seat on a power vehicle, the Hall effect sensor assembly comprising:

a Hall effect sensing element;

a sensor support member supporting the Hall effect sensing element and having a peripheral surface;

a first magnet;

a magnet support member supporting the first magnet and having a peripheral surface, one of the magnet support member and the sensor support member being mounted to the seat and being movable relative to another of the sensor support member and the magnet support member, between a first position and a second position;

wherein the first magnet and the Hall effect sensing element are supported relative to one another so that the peripheral surfaces generally oppose one another and so that the Hall effect sensing element interacts with the first magnet to provide a signal indicative of movement between the first and second positions; and wherein the opposing peripheral surfaces of the magnet support member and the sensor support member are contoured such that clearance between the opposing peripheral surfaces varies.

18. The Hall effect sensor assembly of claim 17 wherein the magnet support member is mounted to the seat and is movable relative to the sensor support housing.

19. The Hall effect sensor assembly of claim 18 wherein the peripheral surface of the magnet support member tapers away from the peripheral surface of the sensor support member.

20. The Hall effect sensor assembly of claim 19 wherein the sensor support member is shaped to partially wrap around the magnet support member and wherein the magnet support member is movable within the sensor support member.

21. The Hall effect sensor assembly of claim 20 wherein the peripheral surface of the sensor support member is an inner surface shaped to generally define an axis and wherein the peripheral surface of the magnet support member is an outer peripheral surface tapered such that clearance between the inner peripheral surface of the sensor support member and the outer peripheral surface of the magnet support member is different when measured at a first point along the axis and at a second point along the axis.

22. The Hall effect sensor assembly of claim 21 wherein the outer peripheral surface of the magnet support member is formed as a conical taper.

23. The Hall effect sensor assembly of claim 21 wherein the outer peripheral surface of the magnet support member has a first conically tapered portion and a second conically tapered portion coupled to the first conically tapered portion at an intermediate portion, clearance between the intermediate portion and the inner peripheral surface of the sensor support member being less than clearance between the inner peripheral surface of the sensor support member and the first tapered portion and between the inner peripheral surface of the sensor support member and the second tapered portion.

* * * * *